US005407636A

United States Patent [19]

Kita

[11] Patent Number: 5,407,636

[45] Date of Patent: Apr. 18, 1995

[54] HIGH-STRENGTH, HEAT-RESISTANT ALUMINUM-BASED ALLOY, COMPACTED AND CONSOLIDATED MATERIAL THEREOF, AND PROCESS FOR PRODUCING THE SAME

[75] Inventor: Kazuhiko Kita, Uozu, Japan

[73] Assignee: YKK Corporation, Tokyo, Japan

[21] Appl. No.: 8,759

[22] Filed: Jan. 25, 1993

[30] Foreign Application Priority Data

Feb. 28, 1992 [JP] Japan ..... 4-043009

[51] Int. Cl.[6] ..... C22C 21/00

[52] U.S. Cl. ..... 420/552; 148/538; 148/552; 148/437; 148/438; 148/439; 148/440; 419/66; 420/535; 420/543; 420/544; 420/551; 420/553

[58] Field of Search ..... 148/538, 552, 437, 438, 148/439, 440; 420/552, 553, 535, 543, 544, 551; 419/66

[56] References Cited

U.S. PATENT DOCUMENTS 5,053,084 10/1991 Masumoto et al. ..... 148/438
5,221,375 6/1993 Nagahora et al. ..... 420/552

FOREIGN PATENT DOCUMENTS 0136508 4/1985 European Pat. Off. .
0487276 5/1992 European Pat. Off. .
3-249148 11/1991 Japan .

*Primary Examiner*—Sam Silverberg
*Assistant Examiner*—Robert R. Koehler
*Attorney, Agent, or Firm*—Flynn, Thiel, Boutell & Tanis

[57] ABSTRACT

An Al-based alloy represented by the general formula $Al_{bal}Ti_aM_b$ and $Al_{bal}Ti_aM_bQ_c$ wherein M represents at least one element selected from among V, Cr, Mn, Co, Cu, Y, Zr, Nb, Mo, Hf, Ta and W; Q represents at least one element selected from Mg and Si; and a, b and c are, in percentages by weight, $7 \leqq a \leqq 20$, $0.2 \leqq b \leqq 20$ and $0.1 \leqq c \leqq 5$. A compacted and consolidated material is produced by melting a material having the above alloy composition, rapidly solidifying the melt into powder or flakes; compacting the resultant powder or flakes; and subjecting the compacted powder or flakes to press forming and consolidating by a conventional plastic working. The aluminum-based alloy and the compacted and consolidated material thereof have a high strength, a good ductility and an excellent strength at high temperatures.

2 Claims, No Drawings

HIGH-STRENGTH, HEAT-RESISTANT ALUMINUM-BASED ALLOY, COMPACTED AND CONSOLIDATED MATERIAL THEREOF, AND PROCESS FOR PRODUCING THE SAME

BACKGROUND OF THE INVENTION

1. Field of the Invention

The present invention relates to a high-strength, heat-resistant aluminum-based alloy having a high strength and ductility and an excellent strength at high temperature, and a compacted and consolidated aluminum-based alloy material produced by compacting and consolidating the alloy and a process for producing the same.

2. Description of the Prior Art

An aluminum-based alloy having a high strength and a high heat resistance has hitherto been produced by the liquid quenching process or the like. In particular, an aluminum-based alloy produced by the liquid quenching process disclose in Japanese Patent Laid-Open No. 275732/1989 is in an amorphous or microcrystalline state and is an excellent alloy having a high strength, a high heat resistance and a high corrosion resistance.

Although the aluminum-based alloy disclosed in the above-described Japanese Patent Laid-Open No. 275732/1989 is an alloy having a high strength, a heat resistance and a high corrosion resistance, and exhibits an excellent workability when it is used as a high-strength material, there is room for improvement when the aluminum-based alloy is used as a material of which a high toughness and a high-temperature strength are required. Accordingly, an object of the present invention is to provide a high-strength aluminum-based alloy having an excellent toughness and a high-temperature strength, a compacted and consolidated material produced therefrom and a process for producing the same.

SUMMARY OF THE INVENTION

The first aspect of the present invention is directed to a high-strength, heat-resistant aluminum-based alloy having a composition represented by the general formula $Al_{bal}Ti_aM_b$, wherein M represents at least one element selected from among V, Cr, Mn, Co, Cu, Y, Zr, Nb, Mo, Hf, Ta and W; and a and b are, in percentages by weight, $7 \leqq a \leqq 20$ and $0.2 \leqq b \leqq 20$.

The second aspect of the present invention is directed to a high-strength, heat-resistant aluminum-based alloy having a composition represented by the general formula $Al_{bal}Ti_aM_bQ_c$, wherein M represents at least one element selected from among V, Cr, Mn, Co, Cu, Y, Zr, Nb, Mo, Hf, Ta and W; Q represents at least one element selected from Mg and Si; and a, b and c are, in percentages by weight, $7 \leqq a \leqq 20$, $0.2 \leqq b \leqq 20$ and $0.1 \leqq c \leqq 5$.

The third aspect of the present invention is directed to a compacted and consolidated material of a high-strength, heat-resistant aluminum-based alloy, which has been produced by compacting and consolidating a rapidly solidified material having a composition represented by the general formula $Al_{bal}Ti_aM_b$, wherein M represents at least one element selected from among V, Cr, Mn, Co, Cu, Y, Zr, Nb, Mo, Hf, Ta and W; and a and b are, in percentages by weight, $7 \leqq a \leqq 20$ and $0.2 \leqq b \leqq 20$.

The fourth aspect of the present invention is directed to a compacted and consolidated material of a high-strength, heat-resistant aluminum-based alloy, which has been produced by compacting and consolidating a rapidly solidified material having a composition represented by the general formula $Al_{bal}Ti_aM_bQ_c$, wherein M represents at least one element selected from among V, Cr, Mn, Co, Cu, Y, Zr, Nb, Mo, Hf, Ta and W; Q represents at least one element selected from Mg and Si; and a, b and c are, in percentages by weight, $7 \leqq a \leqq 20$, $0.2 \leqq b \leqq 20$ and $0.1 \leqq \leqq c \leqq 5$.

The above-described consolidated material consists of a matrix of aluminum or a supersaturated aluminum solid solution whose mean crystal grain size is 40 to 1,000 nm, and, homogeneously distributed in the matrix, particles made of a stable phase or a metastable phase of various intermetallic compounds formed from the matrix element and other alloying elements and/or of various intermetallic compounds formed from other alloying elements themselves, the intermetallic compounds having a mean particle size of 2.5 10 to 800 nm.

The compacted and consolidated aluminum-based alloy material can be produced by melting a material consisting of the above-specified alloy composition, rapidly solidifying the melt into powder or flakes; compacting the resultant powder or flakes; and subjecting the compacted powder or flakes to press forming and consolidating by conventional plastic working.

DETAILED DESCRIPTION OF THE PREFERRED EMBODIMENTS

The aluminum-based alloy of the present invention can be produced by subjecting a molten metal of an alloy having the above-described composition to the liquid quenching process. The liquid quenching process is a process wherein a molten alloy is rapidly cooled. For example, the single-roller melt-spinning process, the twin-roller melt-spinning process, the in-rotating-water melt-spinning process, etc., are particularly useful. In these processes, a cooling rate of about $10^2$ to $10^8$ K/sec can be attained. In producing a thin strip material by the single-roller melt-spinning process, twin-roller melt-spinning process or the like, a molten metal is ejected through a nozzle onto, for example, a copper or steel roll having a diameter of 30 to 300 mm and rotated at a constant speed in the range of from about 300 to 10,000 rpm. Thus, various thin ribbon materials having a width of about 1 to 300 mm and a thickness of about 5 to 500 μm can be easily produced. On the other hand, when a fine wire material is produced by the in-rotating-water melt-spinning process, it can be easily produced by ejecting a molten metal under application of a back pressure of an argon gas through a nozzle into a liquid cooling medium layer having a depth of about 1 to 10 cm and held by a centrifugal force within a drum rotated at about 50 to 500 rpm. In this case, the angle of the molten metal ejected through the nozzle to the cooling medium surface is preferably about 60 to 90, while the relative speed ratio of the ejected molten metal to the liquid cooling medium surface is preferably 0.7 to 0.9.

Instead of using the above-described process, a thin film can be produced by sputtering, and a quenched powder can be produced by various atomization processes, such as the high-pressure gas spraying process, and a spray process.

The alloy of the present invention can be produced by the above-described single-roller melt-spinning process, twin-roller melt-spinning process, in-rotating-water melt-spinning process, sputtering, various atomization processes, spray process, mechanical alloying process, mechanical grinding process, etc. Further, if necessary, the mean crystal grain size and the mean particle size of the intermetallic compounds can be regulated by properly selecting the production conditions.

Further, it is also possible to produce an amorphous structure depending upon the composition. The amorphous structure decomposes into a crystalline structure when heated above a particular temperature. The alloy of the present invention can be produced by the heat decomposition of the amorphous structure. In this case, the mean crystal grain size can be regulated so as to fall within the mean crystal grain size range specified in the present invention by properly selecting the heating conditions.

The compacted and consolidated material of an aluminum-based alloy according to the present invention can be produced by a process comprising melting a material having the above-described composition, rapidly solidifying the melt, compacting the resultant powder or flake, and subjecting the thus-compacted powder or flakes to press forming and consolidating by conventional plastic working techniques. In this case, the powder or flakes as the raw material should comprise an amorphous phase, a supersaturated solid solution or the above-described fine crystalline phase having an average crystal grain size of 1,000 nm or less and a mean intermetallic compound particle size of 10 to 800 nm, or a mixed phase comprised of the above-described phases. In the case of the amorphous material, the fine crystalline phase or mixed phase satisfying the above-described requirement can be formed by heating the amorphous material to 50° to 400° C. during the step of compacting.

The above-described conventional plastic working technique should be interpreted in a broad sense and includes press forming and powder metallurgy techniques.

In the aluminum-based alloy represented by the above-described general formula and the compacted and consolidated material of an aluminum-based alloy represented by the above-described general formula, the values of a, b and c are limited to 7 to 20%, 0.2 to 20% and 0.1 and 5% by weight, respectively, because when a, b and c are in the above-described respective ranges, the material has a higher strength at room temperature to 400° C. than that of the conventional (commercially available) high-strength aluminum-based alloy and a ductility capable of withstanding practical working.

In the aluminum-based alloy and the compacted and consolidated material of an aluminum-based alloy according to the present invention, the Ti element is an element having a small dispersibility in an Al matrix and, when Ti is finely dispersed as an intermetallic compound in the Al matrix, it has the effect of strengthening the matrix and regulating the growth of a crystal grain. Specifically, it can remarkably improve the hardness and strength of the alloy and consolidated material and stabilize the finely crystalline phase not only at room temperature but also at high temperature, so that heat resistance is imparted.

The M element is at least one element selected from among V, Cr, Mn, Co, Cu, Y, Zr, Nb, Mo, Hf, Ta and W. These elements have a small dispersibility in the Al matrix and form various metastable or stable intermetallic compounds, which contribute to the stabilization of the finely crystalline structure.

The Q element is at least one element selected from Mg and Si. It combines with Al or another Q element to form a compound. When these elements are added in a small amount, the formed compound strengthens the matrix, improves the strength and, at the same time, can improve the heat resistance, specific strength and specific elasticity.

In the consolidated material of an aluminum-based alloy according to the present invention, the mean crystal grain size of the matrix is limited to 40 to 1,000 nm because when it is less than 40 nm, the ductility is insufficient through the strength is high, whereas when it exceeds 1,000 nm, the strength lowers. The mean particle size of the intermetallic compounds is limited to 10 to 800 nm because when it is outside the above-described range, the intermetallic compounds do not function as elements for strengthening the Al matrix. Specifically, when the mean particle size is less than 10 nm, the intermetallic compounds do not contribute to the strengthening of the Al matrix. In this case, when the intermetallic compounds are excessively dissolved in the solid solution form in the matrix, there is a possibility that the material might become brittle. On the other hand, when the mean particle size exceeds 800 nm, the size of the dispersed particle becomes excessively large. Consequently, the strength cannot be maintained, and the intermetallic compounds cannot function as strengthening elements. When the mean particle size is in the above-described range, it becomes possible to improve the Young's modulus, high-temperature strength and fatigue strength.

In the consolidated material of an aluminum-based alloy according to the present invention, the mean crystal grain size and the state of dispersion of the intermetallic compounds can be regulated through proper selection of the production conditions. When importance is given to the strength, the mean crystal grain size of the matrix and the mean particle size of the intermetallic compounds are reduced, while when importance is given to the ductility, the mean crystal grain size of the matrix and the mean particle size of the intermetallic compounds are increased, thus preparing consolidated materials suitable for various purposes.

Further, when the mean crystal grain size of the matrix is regulated so as to fall within the range of from 40 to 1,000 nm, it is possible to impart excellent properties necessary as a superplastic working material in the range of a rate of strain of from $10^{-2}$ to $10^{2}$ $S^{-1}$.

Elements such as B and C do not spoil the strength property and heat resistance so far as their amount is 1% or less.

The present invention will now be described in more detail with reference to the following Examples.

EXAMPLES

An aluminum-based alloy powder having a predetermined composition was prepared by a gas atomizing apparatus. The aluminum-based alloy powder thus produced was filled into a metallic capsule, and a billet for extrusion was prepared with degassing by a vacuum hot press. This billet was extruded at a temperature of 200° to 550° C. by an extruder.

Twenty types of consolidated materials (extruded materials) having compositions (% by weight) specified on the left column of Table 1 were prepared under the above-described conditions.

As shown in the right column of Table 1, the consolidated materials are subjected to the measurements of the tensile strength at room temperature, Young's modulus (modulus of elasticity), hardness and the tensile strength at a high temperature of 300° C.

From the results given in Table 1, it is apparent that the consolidated materials according to the present invention have superior properties over the conventional (commercially available) high-strength Al alloys (ultraduralumin), which have a tensile strength of 500 MPa at room temperature and a tensile strength of 100 MPa at a temperature of 300° C or below. Further, it is apparent that the consolidated materials according to the present invention are superior also in Young's modulus (modulus of elasticity) to the conventional (commercially available) high-strength Al alloy (duralumin) having a Young's modulus of about 7,000 kgf/mm$^2$.

temperature to find out that the elongation is above a value which is necessary for general working, that is, above 2%. A test piece was cut out for observation under a TEM from each of the consolidated materials (extruded materials) obtained under the above production conditions, and observation was conducted on the crystal grain size of the matrix and the particle size of the intermetallic compounds. Each of the samples comprised a matrix of aluminum or a supersaturated aluminum solid solution having a mean crystal grain size of 40 to 1,000 nm and particles consisting of a stable phase or a metastable phase of various intermetallic compounds formed from the matrix elements and other alloying elements and/or of various intermetallic compounds formed from other alloying elements homogeneously distributed in the matrix. The intermetallic compounds had a mean particle size of 10 to 800 nm.

TABLE 1

| | Composition (wt. %) | | | | Tensile strength | Young's modulus | Hardness | Tensile strength |
|---|---|---|---|---|---|---|---|---|
| | Al | Ti | Q | M | (MPa) | (GPa) | (Hv) | 300° C.(MPa) |
| Invention Ex. 1 | balance | 7 | — | V = 2.3 | 838 | 89 | 223 | 311 |
| Invention Ex. 2 | balance | 7 | — | Cr = 2.2, Mn = 2.4 | 883 | 87 | 235 | 323 |
| Invention Ex. 3 | balance | 8 | — | Mn = 1.7 | 845 | 85 | 217 | 326 |
| Invention Ex. 4 | balance | 8 | — | Co = 2.3 | 851 | 84 | 200 | 316 |
| Invention Ex. 5 | balance | 9 | — | Cu = 2.4 | 875 | 83 | 213 | 299 |
| Invention Ex. 6 | balance | 9 | — | Y = 5.0 | 832 | 81 | 193 | 332 |
| Invention Ex. 7 | balance | 10 | — | V = 2.3, Zr = 2. | 861 | 89 | 152 | 326 |
| Invention Ex. 8 | balance | 10 | Mg = 0.2 | Nb = 5.0 | 843 | 87 | 161 | 328 |
| Invention Ex. 9 | balance | 11 | Mg = 0.5 | Co = 2.3, Mo = 2.8 | 825 | 77 | 155 | 331 |
| Invention Ex. 10 | balance | 11 | Mg = 0.5 | Hf = 1.7 | 856 | 82 | 217 | 336 |
| Invention Ex. 11 | balance | 12 | Mg = 1.0 | Ta = 3.5 | 833 | 87 | 224 | 326 |
| Invention Ex. 12 | balance | 12 | Mg = 2.0 | W = 2.3 | 869 | 93 | 232 | 341 |
| Invention Ex. 13 | balance | 13 | Mg = 2.5 | V = 3.5 | 908 | 89 | 197 | 345 |
| Invention Ex. 14 | balance | 13 | Mg = 4.0 | Cr = 2.6 | 848 | 83 | 184 | 333 |
| Invention Ex. 15 | balance | 14 | Si = 0.2 | Co = 3.5, Zr = 1.7 | 888 | 88 | 171 | 346 |
| Invention Ex. 16 | balance | 15 | Si = 4.5 | Zr = 3.5 | 847 | 91 | 163 | 341 |
| Invention Ex. 17 | balance | 16 | Si = 0.5 | W = 2.5 | 933 | 95 | 234 | 345 |
| Invention Ex. 18 | balance | 17 | Si = 1.0 | Mn = 6.5 | 899 | 93 | 195 | 346 |
| Invention Ex. 19 | balance | 18 | Si = 2.0 | V = 3.6 | 816 | 84 | 177 | 336 |
| Invention Ex. 20 | balance | 19 | Si = 0.5 | Cr = 4.5, Cu = 4.2 | 986 | 96 | 149 | 321 |

Since the consolidated materials according to the present invention have a high Young's modulus, they have such an effect that the degree of deflection and the degree of deformation are advantageously small when the same load is applied. Therefore, it is apparent that the consolidated material of the present invention has an excellent tensile strength at a temperature of room temperature to a high temperature of 300° C., hardness and Young's modulus.

The hardness was measured with a Vickers microhardness tester under a load of 25 g.

The consolidated materials listed in Table 1 were subjected to the measurement of elongation at room As described above, the aluminum-based alloy of the invention and the compacted and consolidated material thereof have an excellent strength from room temperature to high temperature and have a combination of high toughness with high elasticity, so that they can be applied to a structural material of which excellent workability and high reliability are required. Further, according to the process of the present invention, it is possible to produce a compacted and consolidated material having excellent properties.

What is claimed is:

1. A compacted and consolidated high-strength, heat-resistant, microcrystalline aluminum-based alloy, which has been produced by compacting and consolidating a rapidly solidified alloy having a composition represented by the general formula $Al_{bal}Ti_aM_bQ_c$, wherein M represents at least one element selected from among V, Cr, Mn, Co, Cu, Y, Zr, Nb, Mo, Hf, Ta and W; Q represents at least one element selected from Mg and Si; and a, b and c are, in percentages by weight, $7 \leqq a \leqq 20$ and $0.2 \leqq b \leqq 20$ and $0.1 \leqq c \leqq 5$, the compacted and consolidated alloy consisting of a matrix of aluminum or a supersaturated aluminum solid solution whose mean crystal grain size is 40 to 1,000 nm, and, homogeneously distributed in the matrix, particles made of a stable phase or a metastable phase of various intermetallic compounds formed from the matrix element and other alloying elements and/or of various intermetallic compounds formed from other alloying elements themselves, the intermetallic compounds having a mean particle size of 10 to 800 nm.

2. A process for producing a compacted and consolidated microcrystalline aluminum-based alloy, the process comprising melting an alloy having a composition represented by the general formula $Al_{bal}Ti_aM_bQ_c$, wherein M represents at least one element selected from among V, Cr, Mn, Co, Cu, Y, Zr, Nb, Mo, Hf, Ta and W; Q represents at least one element selected from Mg and Si; and a, b and c are, in percentages by weight, $7 \leqq a \leqq 20$, $0.2 \leqq b \leqq 20$ and $0.1 \leqq c \leqq 5$; rapidly solidifying the melt into powder or flakes; compacting the resultant powder or flakes; and subjecting the compacted powder or flakes to press forming and consolidating by a conventional plastic working, the compacted and consolidated alloy consisting of a matrix of aluminum or a supersaturated aluminum solid solution whose mean crystal grain size is 40 to 1,000 nm, and, homogeneously distributed in the matrix, particles made of a stable phase or a metastable phase of various intermetallic compounds formed from the matrix element and other alloying elements and/or of various intermetallic compounds formed from other alloying elements themselves, the intermetallic compounds having a mean particle size of 10 to 800 nm.

* * * * *